US009291034B2

(12) United States Patent
Turner et al.

(10) Patent No.: US 9,291,034 B2
(45) Date of Patent: Mar. 22, 2016

(54) SELECTIVE FRACTURING TOOL

(75) Inventors: Don Turner, Lloydminster (CA); Sean Campbell, Airdrie (CA); Grant George, Kelowna (CA)

(73) Assignee: Logan Completion Systems Inc., Calgary, Alberta (CA)

( * ) Notice: Subject to any disclaimer, the term of this patent is extended or adjusted under 35 U.S.C. 154(b) by 1062 days.

(21) Appl. No.: 13/266,498

(22) PCT Filed: Apr. 26, 2010 (Under 37 CFR 1.47)

(86) PCT No.: PCT/CA2010/000620

§ 371 (c)(1), (2), (4) Date: Mar. 16, 2012

(87) PCT Pub. No.: WO2010/124371

PCT Pub. Date: Nov. 4, 2010

(65) Prior Publication Data

US 2012/0193098 A1 Aug. 2, 2012

Related U.S. Application Data

(60) Provisional application No. 61/172,915, filed on Apr. 27, 2009.

(51) Int. Cl.

| | |
|---|---|
| ***E21B 34/14*** | (2006.01) |
| ***E21B 43/14*** | (2006.01) |
| ***E21B 43/26*** | (2006.01) |

(52) U.S. Cl.

CPC ..... *E21B 34/14* (2013.01); *E21B 43/14* (2013.01); *E21B 43/26* (2013.01)

(58) Field of Classification Search

CPC ..... E21B 23/04; E21B 34/08; E21B 34/10; E21B 34/105; E21B 34/14; E21B 43/25; E21B 43/26; E21B 2034/002

USPC ..... 166/373, 381, 383, 386, 318, 332.1, 166/332.4

See application file for complete search history.

(56) References Cited

U.S. PATENT DOCUMENTS

| | | | |
|---|---|---|---|
| 3,244,234 | A | 4/1966 | Flickinger |
| 4,512,406 | A | 4/1985 | Vann et al. |

(Continued)

FOREIGN PATENT DOCUMENTS

| | | | |
|---|---|---|---|
| CA | 2412072 | A1 | 5/2003 |
| CA | 2471599 | A1 | 7/2003 |

(Continued)

OTHER PUBLICATIONS

Canadian Office Action received in Canadian Patent Application No. 2,731,161, dated Dec. 13, 2011, 3 pages.

(Continued)

*Primary Examiner* — Elizabeth Gitlin

(74) *Attorney, Agent, or Firm* — Hubbard Law, PLLC

(57) ABSTRACT

A tool for selectively treating a wellbore with fluid that includes a tubing string having a sidewall defining an inner bore, the sidewall comprising a flow area having at least one fluid flow port that permits fluid flow through the sidewall. Fluid is prevented from flowing through the flow area when a closure is in a closed position. When in the open position, fluid flows through the flow area. An axial seal is connected to the closure to selectively close the inner bore against fluid pressure to apply the predetermined opening force to move the closure to the open position. A releasable connector connects the axial seal to the closure and a retrieval tool attachment releases the axial seal from the closure upon application of a predetermined release force by a retrieval tool.

22 Claims, 7 Drawing Sheets

(56) References Cited

U.S. PATENT DOCUMENTS

| | | | | |
|---|---|---|---|---|
| 5,048,611 | A | 9/1991 | Cochran | |
| 5,168,931 | A | 12/1992 | Caskey et al. | |
| 5,358,048 | A | 10/1994 | Brooks | |
| 5,443,124 | A | 8/1995 | Wood et al. | |
| 6,186,236 | B1 | 2/2001 | Cox | |
| 6,253,856 | B1 | 7/2001 | Ingram et al. | |
| 6,488,082 | B2 | 12/2002 | Echols et al. | |
| 6,695,057 | B2 | 2/2004 | Ingram et al. | |
| 6,776,238 | B2 | 8/2004 | Dusterhoft et al. | |
| 6,782,948 | B2 | 8/2004 | Echols et al. | |
| 6,907,936 | B2 | 6/2005 | Fehr et al. | |
| 7,021,384 | B2 | 4/2006 | Themig | |
| 7,096,954 | B2 | 8/2006 | Weng et al. | |
| 7,108,067 | B2 | 9/2006 | Themig et al. | |
| 7,114,558 | B2 | 10/2006 | Hoffman et al. | |
| 7,134,505 | B2 | 11/2006 | Fehr et al. | |
| 7,267,172 | B2 | 9/2007 | Hofman | |
| 7,350,582 | B2 | 4/2008 | McKeachnie et al. | |
| 7,353,878 | B2 | 4/2008 | Themig | |
| 7,431,091 | B2 | 10/2008 | Themig et al. | |
| 7,543,634 | B2 | 6/2009 | Fehr et al. | |
| 7,748,460 | B2 | 7/2010 | Themig et al. | |
| 7,762,333 | B2 | 7/2010 | Themig et al. | |
| 7,861,774 | B2 | 1/2011 | Fehr et al. | |
| 7,992,645 | B2 | 8/2011 | Themig | |
| 8,727,010 | B2 * | 5/2014 | Turner et al. | 166/332.4 |
| 2003/0127227 | A1 | 7/2003 | Fehr et al. | |
| 2004/0020652 | A1 | 2/2004 | Campbell et al. | |
| 2006/0000620 | A1 | 1/2006 | Hamilton | |
| 2006/0124310 | A1 | 6/2006 | Lopez de Cardenas et al. | |
| 2007/0204995 | A1 | 9/2007 | Hofman et al. | |
| 2007/0240883 | A1 | 10/2007 | Telfer | |
| 2007/0272413 | A1 | 11/2007 | Rytlewski et al. | |
| 2008/0135248 | A1 | 6/2008 | Talley et al. | |
| 2009/0008083 | A1 | 1/2009 | Themig et al. | |
| 2009/0071644 | A1 | 3/2009 | Themig | |
| 2009/0095471 | A1 | 4/2009 | Guignard et al. | |
| 2010/0263873 | A1 | 10/2010 | Turner et al. | |
| 2011/0067890 | A1 | 3/2011 | Themig | |
| 2011/0100643 | A1 | 5/2011 | Themig et al. | |
| 2011/0127047 | A1 | 6/2011 | Themig et al. | |
| 2011/0278017 | A1 | 11/2011 | Themig et al. | |

FOREIGN PATENT DOCUMENTS

| | | | |
|---|---|---|---|
| CA | 2437635 | A1 | 2/2004 |
| CA | 2472824 | A1 | 12/2005 |
| CA | 2628368 | A1 | 8/2009 |
| CA | 2637519 | A1 | 10/2009 |
| CA | 2719561 | A1 | 11/2009 |
| CA | 272620 | A1 | 12/2009 |
| CA | 2726207 | A1 | 12/2009 |
| CA | 2641778 | | 4/2010 |
| CA | 2682621 | | 4/2010 |
| CA | 2731161 | | 11/2010 |
| WO | WO-03056131 | A1 | 7/2003 |
| WO | WO-2010124371 | | 11/2010 |
| WO | WO-2011057416 | A1 | 5/2011 |
| WO | WO-2011072367 | A1 | 6/2011 |
| WO | WO-2011079391 | A1 | 7/2011 |
| WO | WO-2011130846 | A1 | 10/2011 |

OTHER PUBLICATIONS

Canadian Office Action received in Canadian Patent Application No. 2,731,161, dated Jul. 11, 2011, 3 pages.

"Multi-Stage System Completion With Packers," Xtreme Oil Tools; Strata-Pak System Information, at least as early as Oct. 2009 (3 pages).

International Search Report for PCT Application No. PCT/CA2010/000620, dated Sep. 20, 2010.

"Design and Installation of a Cost-Effective Completion System for Horizontal Chalk Wells Where Multiple Zones Require Acid Stimulation," D.W. Thompson, SPE and M.F. Nazroo, SPE Drilling & Completion, Sep. 1998, pp. 151-156.

* cited by examiner

SELECTIVE FRACTURING TOOL

FIELD

This relates to a tool for selectively fracturing a formation containing hydrocarbons.

BACKGROUND

U.S. Pat. No. 7,108,067 (Themig et al.) entitled "Method and apparatus for wellbore fluid treatment" describes a tool in which sleeves are shifted in order to open fracing ports.

SUMMARY

There is provided a tool for selectively treating a wellbore with fluid that includes a tubing string having a sidewall defining an inner bore, the sidewall comprising a flow area having at least one fluid flow port that permits fluid flow through the sidewall. A closure is movably positioned over the flow area and prevents fluid flow through the flow area in a closed position and allows fluid flow in an open position. An axial seal is connected to the closure to selectively close the inner bore against fluid pressure to apply the predetermined opening force to move the closure to the open position. A releasable connector connects the axial seal to the closure and a retrieval tool attachment releases the axial seal from the closure upon application of a predetermined release force by a retrieval tool.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
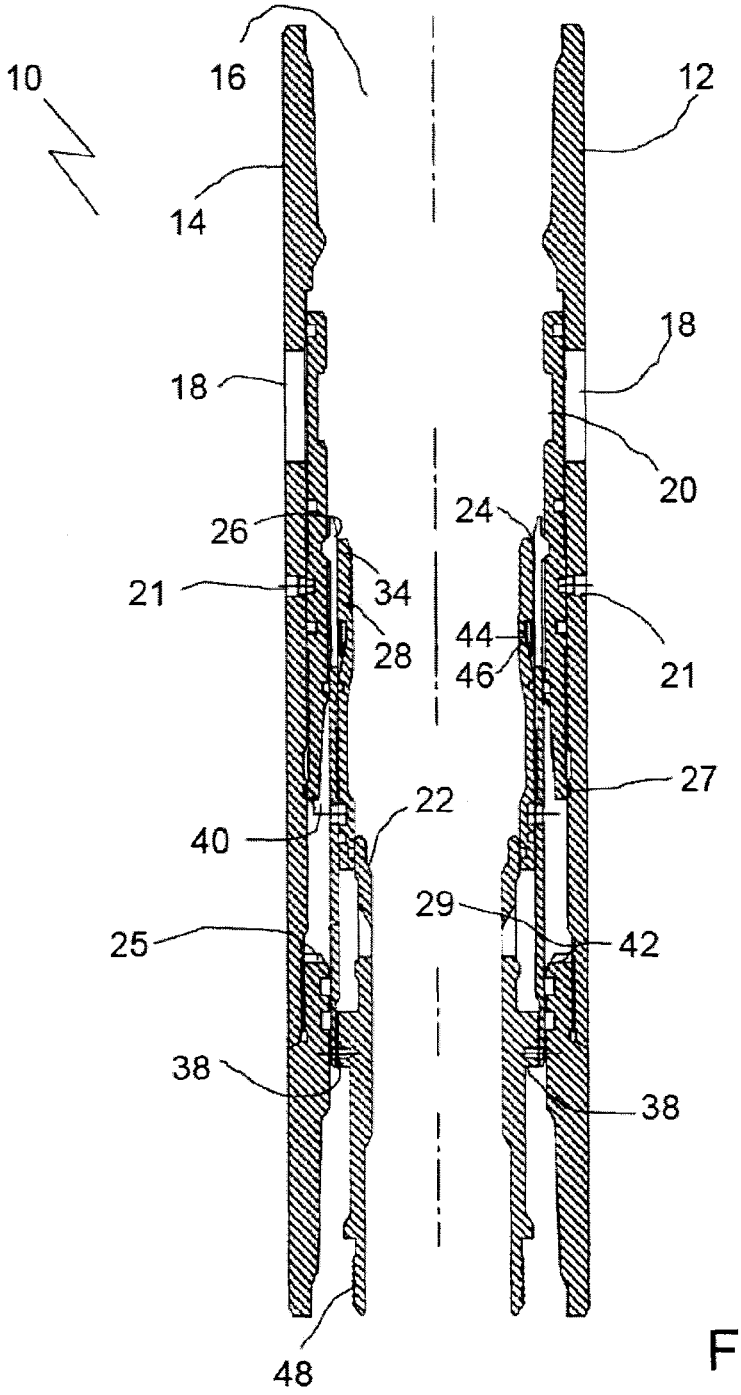
FIG. 1 is a side elevation view, in section, of the selective fracturing tool.

A selective fracturing tool, generally identified by reference numeral 10, will now be described with reference to FIG. 1 through 7.

Figure 2:
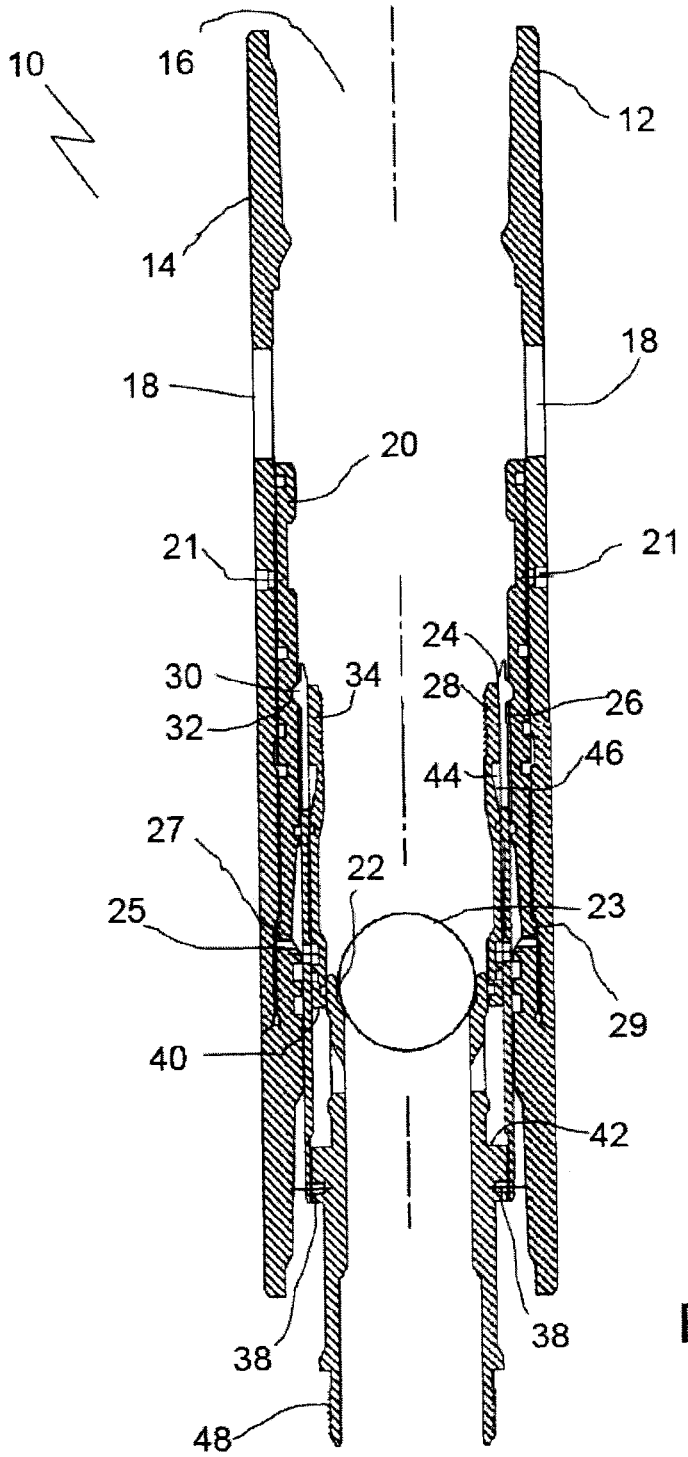
FIG. 2 is a side elevation view, in section, of the selective fracturing tool shown in FIG. 1 with flow ports in the open position.
Figure 4:
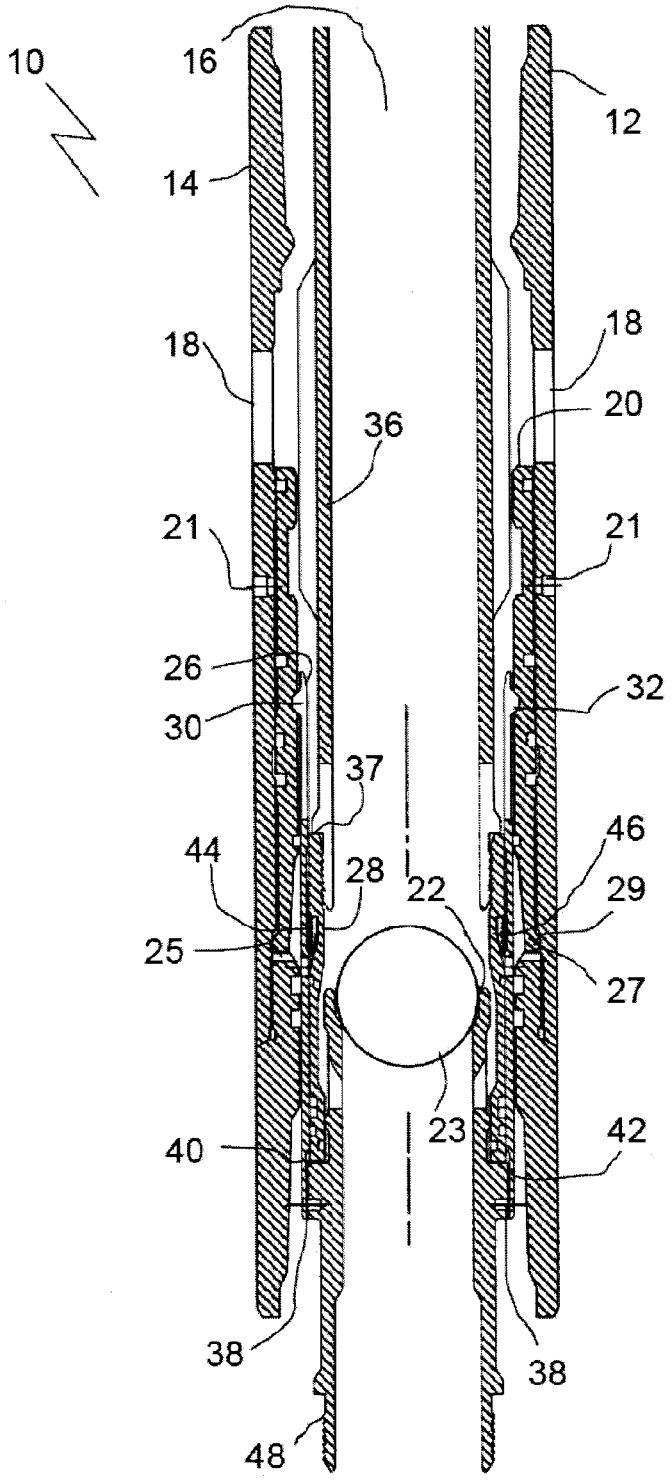
FIG. 4 is a side elevation view, in section, of the selective fracturing tool shown in FIG. 1 with the removal tool locked in position
Figure 5:
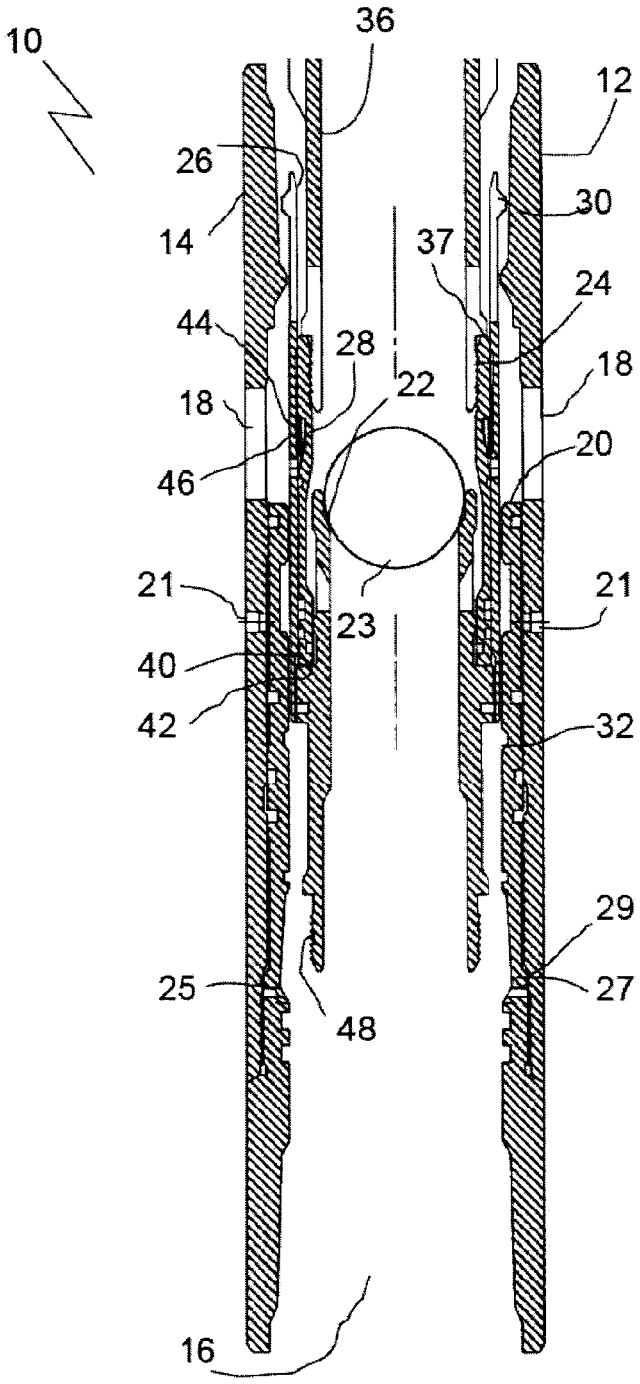
FIG. 5 is a side elevation view, in section, of the selective fracturing tool shown in FIG. 1 with the removal tool removing the ball seat.

Referring to FIG. 1, tool 10 has a tubing string 12 having a sidewall 14, an inner bore 16 and flow areas made up of one or more flow ports 18 that permit fluid flow through sidewall 14. A closure 20 is positioned over flow ports 18. As shown, closure 20 is an annular sleeve that shifts axially within sidewall 14, and is connected to sidewall 14 by shear pins 21. Closure 20 is initially in a closed position as shown in FIG. 1 to prevent fluid flow through flow ports 18, and may be moved to an open position, shown in FIG. 2 and described below, to allow fluid to flow through flow ports 18. As shown in FIG. 4, tubing string 12 includes multiple flow areas 18 that are axially spaced, each having a closure 20 and the other components described below. An axial seal 22, such as a ball seat as depicted, is connected to closure 20. Axial seal 22 is initially in an open position, but may be closed to seal inner bore 16, such as by placing a ball 23 in ball seat 22, which allows pressure to be applied to closure 20 to move closure 20 to the open position. Axial seal 22 is attached to closure 20 via a releasable connector 24 that is released by a retrieval tool as discussed below. Referring to FIG. 2, in the depicted embodiment, a ball 23 is pumped down tubing string 12 and engages ball seat 22. Fluid pressure is then applied by increasing the hydrostatic pressure in inner bore 16. This causes closure 20 to shear shear pins 21 and shift axially to open flow ports 18. It will be understood that closure 20 may also open flow ports 18 by, for example, being rotated by the fluid pressure applied to ball seat 22. In addition, other means of releasing closure 20 may also be used. In the open position, closure 20 is stopped by a shoulder 25 on sidewall 14, and preferably has a latch end 27 that engages a latching profile 29 in sidewall 14 to prevent it from unintentionally returning to the closed position.

Preferably, when multiple closures 20 are selectively shifted, the diameter of downstream ball seats 22 are progressively smaller than the upstream ball seats 22, such that a smaller ball may be pumped down through other, larger, ball seats 22 to the end of tubing string 12 to open that closure. The next ball will be larger to engage the next ball seat 22, but still small enough to pass through the upstream ball seats 22, and so forth so that all closures 20 are opened.

Figure 3:
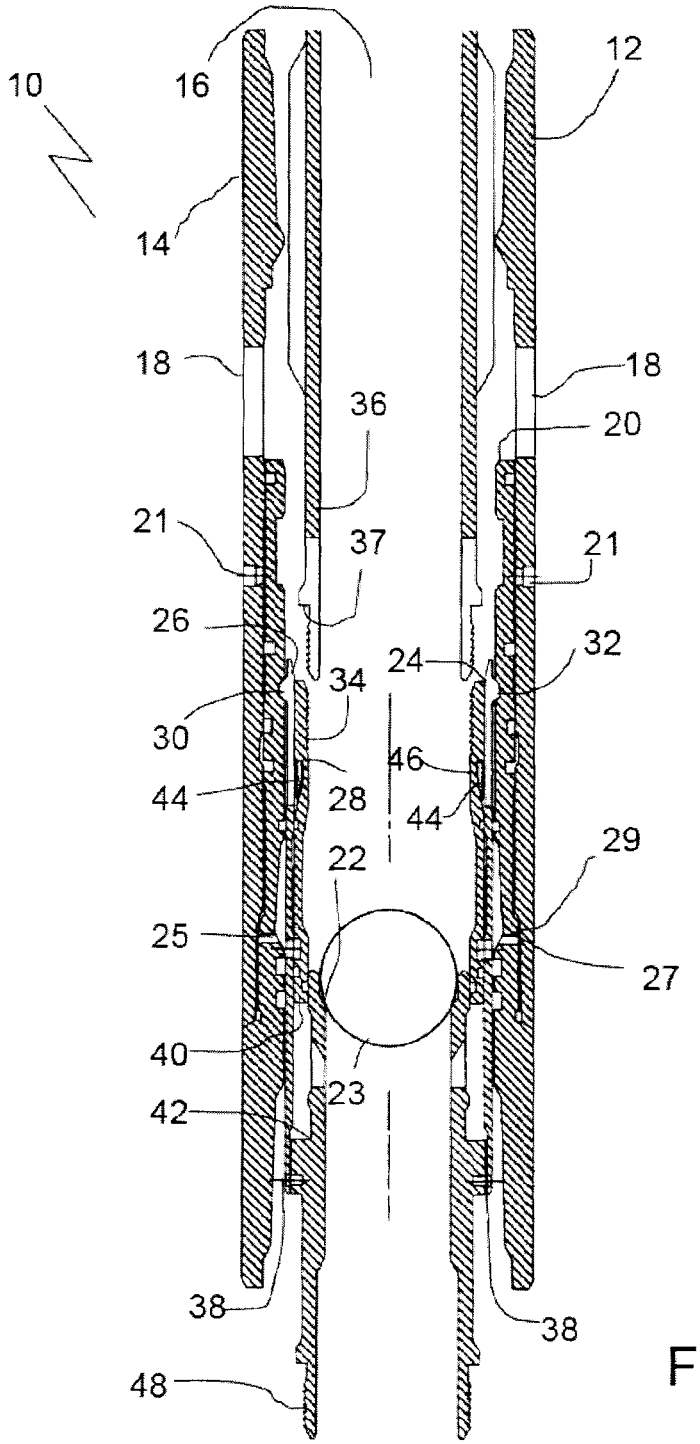
FIG. 3 is a side elevation view, in section, of the selective fracturing tool shown in FIG. 1 with a removal tool inserted.

Referring to FIG. 3, once opened, axial seal 22 can then be removed to provide "full bore" access to tubing string 12 by releasing releasable connector 24. In the depicted embodiment, releasable connector 24 is made up of a diameter reducing sleeve 26 and a locking sleeve 28. Sleeve 26 has an outer profile 30 that engages a corresponding profile 32 on closure 20. As shown, profiles 30 and 32 are sloped on both sleeve 26 and closure 20. This portion of sleeve 26 is a diameter reducing section. This may be done by providing a series of resilient fingers that, when an axial force is applied in either direction, bend inward to release sleeve 26 from closure 20. Preferably, the fingers are biased inward, such that once they are released, they do not catch on closure 20. The space between the resilient fingers may be filled with a compressible substance to properly seal sleeve 26. Axial seal 22 is attached, such as by pins 27, to the other end of diameter-reducing sleeve 26. Sleeve 28 is a locking sleeve that prevents diameter reducing sleeve from being released from profile 32 on closure 20. Locking sleeve 28 has a retrieval tool attachment 34 at one end that engages a retrieval tool 36, and is connected by shear pins 38 to one of axial seal 22 or sleeve 26 at the other end.

Referring to FIG. 4, as shown, retrieval tool 36 engages retrieval tool attachment 34 using a ratchet design that allows it to be inserted in one direction, and afterward locks in place. Retrieval tool 36 has a shoulder 37 to prevent it from being inserted too far into locking sleeve 28. Shoulder 37 is then used to apply pushing forces to locking sleeve 28. When retrieval tool 36 applies a sufficient force to release shear pins 38, locking sleeve 28 shifts downward and diameter reducing section is no longer locked in place. Locking sleeve 28 then becomes locked into this release position, as the downstream end 40 of locking sleeve 28 comes into contact with a shoulder 42 of axial seal 22, and dogs 44, which are mounted in a groove 46 locking sleeve 28 against a sloped outer surface, engage diameter reducing sleeve 26 by friction to prevent locking sleeve 28 from moving back to the locked position. This allows a pushing or pulling force to be applied by retrieval tool 36 at this point that will move axial seal 22 and sleeves 26 and 28 together to remove retrieval tool 36.

Figure 7:
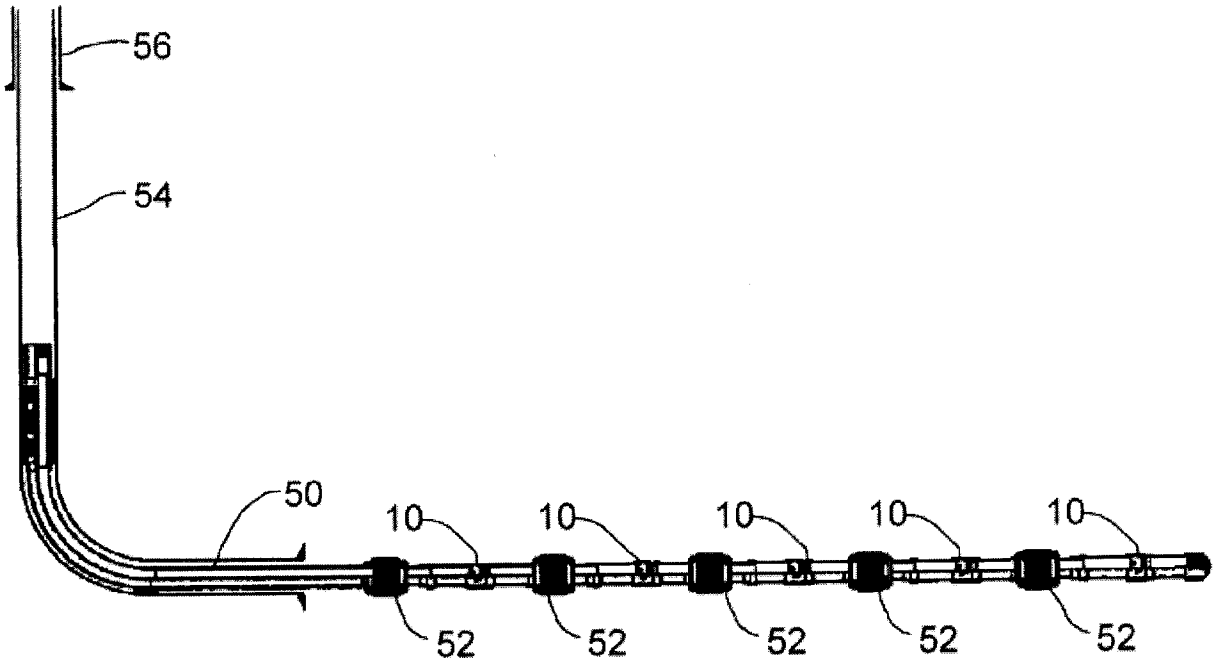
FIG. 7 is a side elevation view of a tubing string containing a series of selective fracturing tools.

Referring to FIG. 7, a series of selective fracing tools 10 are deployed along a production tubing string 50 with packers 52, such as hydraulically set dual element open hole packers. The type of packer used will be selected based on the conditions and preferences of the user. Tubing string 50 is inserted into the casing 54 of a wellbore 56, such that tool 10 is aligned with the portion of the formation to be fraced.

Figure 6:
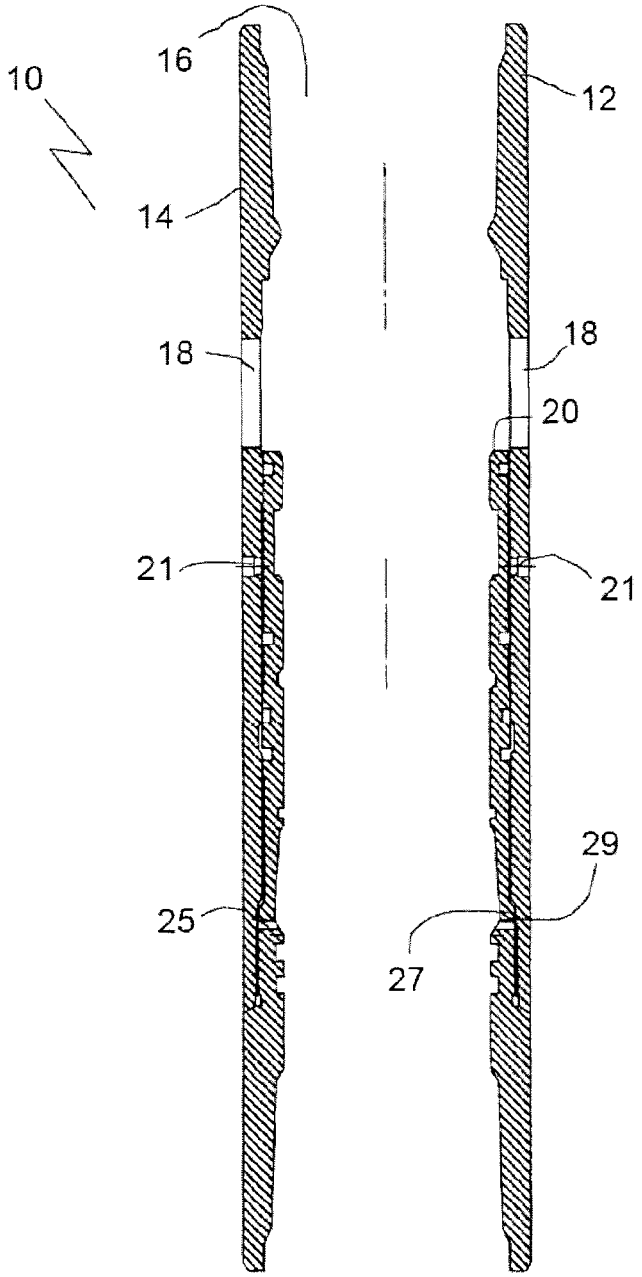
FIG. 6 is a side elevation view, in section, of the selective fracturing tool shown in FIG. 1 with full bore access.

When multiple fracing tools 10 are used as shown in FIG. 7, each axial seal 22 may be removed individually to obtain the full bore flow path shown in FIG. 6. In this approach, retrieval tool 36 is inserted once for each axial seal 22. Alternatively, more than one axial seal 22 may be removed in multiples. As shown, in FIG. 4, axial seal 22 has a downstream end 48 that has a similar connection as retrieval tool 36. Once an upstream axial seal 22 is released, it may be pushed to engage the next downstream axial seal 22, where downstream end 48 engages retrieval tool attachment 34 of the next axial seal 22. At this point, axial seal 22 can be considered part of the retrieval tool 36. The axial seals 22 can then be pulled out of tubular body 12 at the same time.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A tool for selectively treating a wellbore with fluid, comprising:

tubing having a sidewall defining an inner bore, the sidewall comprising a flow area having at least one fluid flow port that permits fluid flow through the sidewall;

a closure positioned over the flow area, the closure movable from a closed position that prevents fluid flow through the flow area to an open position that allows fluid flow through the flow area upon application of a predetermined opening force;

an axial seal connected to the closure, the axial seal selectively closing the inner bore against fluid pressure to apply the predetermined opening force to move the closure to the open position;

a releasable connector connecting the axial seal to the closure; and wherein the tubing comprises multiple flow areas axially spaced along the sidewall, each flow area having an associated closure, axial seal, releasable connector, and retrieval tool attachment; and wherein the releasable connector comprises:

a diameter reducible sleeve that engages the closure; and a locking sleeve having a locking position over the diameter reducible sleeve and a release position axially shifted from the diameter reducible sleeve, the locking sleeve being shiftable to the release position upon application of the predetermined release force.

2. The tool of claim 1, wherein the axial seal is a ball seat that receives a pumped ball.

3. The tool of claim 1, wherein each axial seal is a ball seat, the diameter of the ball seats varying along the length of the tubing string.

4. The tool of claim 1, wherein the axial seal is secured to the diameter reducible sleeve and the locking sleeve is releasably secured to one of the axial seat and the diameter reducible sleeve by shear pins.

5. The tool of claim 1, wherein the locking sleeve is permitted to move relative to the diameter reducible portion in a first direction, and locks against the diameter reducible portion in an opposed, second direction.

6. The tool of claim 1, wherein the axial seal and the releasable connector are removed from the tubing string upon application of a force applied by the retrieval tool after the axial seal has been released from the closure.

7. The tool of claim 1 further comprising a downstream end of the first axial seal for connecting to a second axial seal of a second closure downstream from the first axial seal.

8. The tool of claim 7, wherein the second axial seal is connected with the second closure by a second releasable connector, wherein the downstream end of the first axial seal is configured for applying a force for releasing the second releasable connector once the first axial seal is released from the first closure and moved downstream for connection to the second axial seal.

9. The tool of claim 8, further comprising a retrieval tool for lowering through the inner bore and applying a force for releasing the first axial seal from the first closure.

10. The tool of claim 7, wherein the first and second axial seals are each comprised of a ball seat for receiving a pumped ball to close the inner bore.

11. The tool of claim 10, wherein the ball seat for the first axial seal has a larger diameter than the ball seat of the second axial seal.

12. A method of selectively treating a wellbore with fluid, comprising the steps of:

providing:

tubing having a sidewall defining an inner bore, the sidewall comprising a first flow opening that permits fluid flow through the sidewall;

a first closure positioned over the first flow opening;

a first axial seal connected to the first closure in an open state; and a first releasable connector connecting the first axial seal to the first closure;

closing the first axial seal and applying a predetermined opening force to move the first closure to an open position that permits fluid flow through the first flow opening;

inserting a retrieval tool into the tubing string and attaching the retrieval tool to the first axial seal; and releasing the first axial seal from the first closure by applying with the retrieval tool a predetermined release force to the first releasable connector;

wherein the first releasable connector comprises:

a diameter reducible sleeve that engages the closure; and a locking sleeve having a locking position over the diameter reducible sleeve and a release position axially shifted from the diameter reducible sleeve, the locking sleeve being shifted to the release position upon application of the predetermined release force.

13. The method of claim 12, comprising, for at least one additional flow opening, repeating the steps of:

closing the axial seal and applying a predetermined opening force to move the closure to an open position that permits fluid flow through the flow opening;

inserting the retrieval tool into the tubing string and attaching the retrieval tool to the axial seal;

releasing the axial seal from the closure by applying a predetermined release force to the releasable connector.

14. The method of claim 12, wherein the axial seal is a ball seat that receives a pumped ball.

15. The method of claim 12, wherein each axial seat is a ball seat, the diameter of the ball seats varying along the length of the tubing string.

16. The method of claim 12, wherein the axial seal is secured to the diameter reducible sleeve and the locking sleeve is releasably secured to one of the axial seat and the diameter reducible sleeve by shear pins.

17. The method of claim 12, wherein the locking sleeve is permitted to move relative to the diameter reducible portion in a first direction, and locks against the diameter reducible portion in an opposed, second direction.

18. The method of claim 12, wherein the axial seal and the releasable connector are removed from the tubing string upon application of a force applied by the retrieval tool after the axial seal has been released from the closure.

19. The method of claim 12, further comprising removing the retrieval tool and the axial seal from the tubing string.

20. The method of claim 12, wherein the tubing string further comprises a second flow opening axially spaced downstream from the first flow opening, a second closure positioned over the second flow opening, and a second axial seal connected to the second closure by a second releasable connector; wherein a downstream end for at least the axial seal is configured for connecting to the second axial seal; and wherein the method further comprises:

moving the first axial seal of the first flow port toward the second axial seal of the second flow port; and releasing the second axial seal from the second closure of the second flow port with the downstream end of the first axial seal.

21. The method of claim 20, wherein the first and second axial seals are pushed toward the end of the well bore.

22. The method of claim 20, wherein the first and second axial seals are pulled together with the retrieval tool through the tubing toward the surface of the well.

* * * * *